US005992334A

United States Patent [19]

von Wedel

[11] Patent Number: 5,992,334

[45] **Date of Patent: *Nov. 30, 1999**

[54] LOOSE-MATERIAL GRATE WITH VOLUMETRIC CONTROL OF GASEOUS COOLANT

[76] Inventor: Karl von Wedel, Gerberhof 5, D-31535 Neustadt, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/911,675

[22] Filed: Aug. 15, 1997

[30] Foreign Application Priority Data

Aug. 22, 1996 [DE] Germany ..... 196 33 969

[51] Int. Cl.[6] ..... F23H 3/00; F23H 17/08; F23H 1/02

[52] U.S. Cl. ..... 110/300; 110/298; 110/268; 126/163 R; 126/153; 126/152 B

[58] Field of Search ..... 110/267, 268, 110/307, 327, 328, 298, 299, 300; 126/152 R, 163 R, 153, 160, 167, 168, 152 B; 432/121, 239, 241, 249; 414/147, 150

[56] References Cited

U.S. PATENT DOCUMENTS

| | | | |
|---|---|---|---|
| 1,378,086 | 5/1921 | Berge | 126/153 |
| 4,600,380 | 7/1986 | Wedel | 432/58 |
| 4,762,489 | 8/1988 | Schmits et al. | 432/77 |
| 4,870,913 | 10/1989 | Schneider | 110/299 |
| 4,966,548 | 10/1990 | Wedel | 432/77 |
| 5,069,146 | 12/1991 | Dethier | 110/281 |
| 5,572,937 | 11/1996 | Tegtmeier et al. | 110/300 |
| 5,575,642 | 11/1996 | Willis et al. | 432/78 |
| 5,871,348 | 2/1999 | Terry et al. | 126/163 R X |
| 5,882,189 | 3/1999 | Fehsenmayr et al. | 110/268 X |

FOREIGN PATENT DOCUMENTS

| | | | |
|---|---|---|---|
| 199593 | 7/1907 | Germany | 110/299 |
| 31 48 792 | 7/1983 | Germany . | |
| 44 41 009 | 5/1996 | Germany . | |
| 93/23708 | 11/1993 | WIPO | 110/299 |

OTHER PUBLICATIONS

Webster's II New Riverside University Dictionary, The Riverside Publishing Company, p. 679, 1994.

*Primary Examiner*—Ira S. Lazarus
*Assistant Examiner*—Ljiljana V. Ciric
*Attorney, Agent, or Firm*—Flynn, Thiel, Boutell & Tanis, P.C.

[57] ABSTRACT

A loose-material grate includes a grate surface for receiving loose material and a chamber arrangement below the grate surface supplies the grate surface with a gas, for example cooling air. A lattice arrangement with adjustable openings is provided spaced from the grate surface. The adjustable openings communicate with grate surface openings of the associated grate surface. The lattice arrangement preferably is divided into several lattice sections, which have openings adjusted independently from one another, whereby the adjustable openings of the lattice sections, each sealed off from other lattice sections, communicate with the grate surface openings of associated areas of the grate surface. The adjustable openings of the lattice sections enable adjustment of the resistance of the grate, if necessary, differently at various grate sections depending on the demands for cooling.

14 Claims, 4 Drawing Sheets

LOOSE-MATERIAL GRATE WITH VOLUMETRIC CONTROL OF GASEOUS COOLANT

FIELD OF THE INVENTION

The present invention relates to a loose-material grate of the type with structure for volume control of gas flow therethrough.

BACKGROUND OF THE INVENTION

A typical use of such loose-material grates is for the cooling of fired cement clinkers by means of air; the invention being illustrated using this as an example. However, the invention can be applied very generally to each grate arrangement in which loose material received on the grate surface is treated by means of a gas flowing from below through the grate surface.

In the case of loose-material grates, one basically differentiates between a so-called chamber ventilation arrangement by means of ventilation chambers arranged below the grate surface, and a so-called channel ventilation arrangement (also called the direct ventilation), in which the individual rows of grates are designed as individual air beams and are connected to a separate air-connection channel (see, for example, DE 33 32 592). The channel ventilation arrangement is mainly utilized in the field of stepped thrust grates in which fixed rows of grates alternate with rows of grates movable in a transporting direction of the loose material.

The channel ventilation arrangement offers, compared with the chamber ventilation arrangement, the possibility of carrying out, at least in the area of the individual rows of grates, a ventilation control by means of flaps or the like arranged in the associated air-supply channel. The channel ventilation arrangement adapts the grate better to varying ventilation demands in different grate areas, for example, to a cooling-performance demand decreasing in a transporting direction of the grate. However, it has been found that such a controllable channel ventilation does not permit a sufficiently quick reaction to changed conditions in the loose-material bed. For example, in an air breakthrough or the like, the associated control members always react with an unacceptable time delay to an already occurred change, for example an air breakthrough.

Already during the introduction of the air-beam technique with the possibility of the channel ventilation arrangement, the knowledge was therefore mainly taken into consideration that the grate resistance is the deciding operating factor of the grates in order to achieve a constant bed ventilation and to, for example, prevent damaging air breakthroughs in the loose-material bed. The air-beam technique makes it possible to make the grate resistance high and to correspondingly increase the pressure of the cooling air in the air beam without having to at the same time accept thereby high air losses in the damaging gaps existing between the adjacent rows of grates or between these and the lateral grate boundaries.

When the resistance coefficient of the grate is high and the resistance portion of the grate relative to the entire resistance comprising the bed resistance is large, then changes in the bed resistance, as they occur, for example, suddenly in the case of air breakthroughs, have a lesser effect than in the case of a low grate resistance, as can be proven. The resistance increases in the case of an air breakthrough at the breakthrough point proportionally equally in time and thus essentially blocks the air so that the air breakthrough does not increase further and balancing flows from other grate areas are essentially avoided.

When the air-beam technique was introduced, the necessity of blocking air for the above-mentioned undesired gaps, in particular the thrust gaps between fixed and movable rows of grates, became very quickly obvious. This blocking air blocks the gaps against falling material, which causes, for example in a red-hot state, damage in the lower grate or which is absorbed again by the cooling air as dust and causes wear in the grate. The blocking air is generally supplied from below to the grate through additional ventilation chambers provided solely for this purpose or as a branch of the cooling air provided for the air beam. Due to an increasing wear and thus larger gaps with time, more and more blocking air was needed so that in older systems the unintended blocking-air portion was above the air portion desired for the channel ventilation through the air beams.

With this the principle of the channel ventilation led to ad absurdum.

Besides the blocking-air problems, a further deficiency of the air-beam technique is that a sufficiently small-cell division of the grate surface into separately defined areas cannot be achieved. A small-cell division of the grate surface would be desirous in order to, on the one hand, prevent balancing flows over larger areas and in order to, on the other hand, enable a freer design of the blow-off profile over the grate surface and thus an optimum adaptation to varying cooling needs. The technical expense for the air-supply channels and control valves associated with the individual cells stands in the way of such a small-cell division. Aside of the construction expense there also is the considerable amount of expense associated with adjustment. Common controls function in such a manner that first an interference value must occur before the adjustment can occur. A premature recognition of the interference values within small cells through a monitoring of the amounts of air would be too complicated and expensive.

The blocking-air problems have been essentially overcome by a special, wear-resistant suspension of the movable structure of the grate carrying the moved rows of grates (DE 38 44 493) and an improved fastening of the grate elements (DE 44 41 009). The possibility to realize an optimized grate resistance, separately for the conditions of individual grate sections, for example with a right/left differentiation adapted to different grain sizes or with a dropping rate of air flow in direction of the loose-material conveyance, fails, however, because of the already above-mentioned technical expense for a small-cell division of the grate surface.

SUMMARY OF THE INVENTION

The purpose of the present invention is to provide a loose-material grate of the type with structure for volume control of gas flow therethrough, which makes it possible to adapt the grate resistance better than up to now to the existing operating conditions.

This purpose is attained according to the invention in such a manner that a lattice arrangement with adjustable openings is provided directly below the grate surface, which openings, sealed off against the surroundings, communicate with the openings of the associated grate surface. The lattice arrangement, which is arranged below the grate surface with a nonchangeable resistance coefficient, represents at the same time a changeable advancing resistance, which is to be added to the resistance of the grate resistance. It is possible in this manner to very the total resistance of the loose-material grate in a wide range between the basic resistance given by the actual grate surface with the lattice arrangement being completely open and an infinite resistance with the lattice arrangement being completely closed.

A further advantage is seen in the actual grate surface on the one hand and the lattice arrangement on the other hand being able to be adapted structurally at an optimum to the tasks intended for them. The actual grate surface can furthermore be designed at an optimum with respect to its structure, the choice of material and the like for its task to receive and, if necessary, move the hot clinker, whereas the total resistance of the grate can be controlled through the relatively little stressed lattice arrangement.

In order to be able to individually control different grate-surface sections with respect to their resistance, the lattice arrangement is, according to one embodiment of the invention, divided into several lattice sections, which can be adjusted independently from one another, whereby the lattice sections, each sealed off against the surroundings, communicate with the associated areas of the grate surface. This structural solution also guarantees that, for example, in the case of an air breakthrough at a point of the clinker bed at least in a flow direction behind the lattice arrangement, cross flows from other lattice sections to the point of the air breakthrough are avoided. Thus a drop in pressure at different areas of the grate surface is avoided. Balancing flows in front of the lattice arrangement are limited by the resistance of this lattice arrangement.

The invention provides in a loose-material grate with means for conveying the loose material in a longitudinal direction of the loose-material grate toward its output end such that the lattice arrangement is divided into several lattice sections arranged one behind the other in conveying direction. This arrangement makes it possible, for example, to load the loose-material grate in the conveying direction, namely, in the direction of the cooling advancing flow of air. An air flow is decreased by increasing the grate resistance toward the end of the grate.

In order to also make possible a differentiation transversely with respect to the conveying direction, it is furthermore provided according to the invention that the lattice arrangement is divided into several lattice sections arranged side-by-side with respect to the longitudinal direction.

A further embodiment of the invention provides that, for example, in the manner described earlier in connection with the air-beam technique each of several boxlike grate elements with a gas-inlet opening constructed in its underside are placed on a grate bearer formed of two parallel bars, whereby below the gas-inlet openings of the grate elements within the grate bearer there is arranged a lattice section associated with it. In this manner it is possible to carry out the cooling-air supply to the individual rows of grates by means of a common chamber ventilation, which also delivers the blocking air, whereby the individual rows of grates can still be adapted individually to the respective cooling-air need by adjusting the respectively associated lattice section.

In the case of grate bearers, which are aligned transversely with respect to the conveying direction, a further embodiment of the invention provides that the lattice section associated with one grate bearer is divided into at least two partial lattice sections arranged side-by-side with respect to the conveying direction in order to be able to carry out the earlier discussed right/left division of the grate.

The lattice arrangement is, in a preferred embodiment of the invention, designed as a slide-plate lattice with stationary plates and movable slide plates movable relative to these stationary plates. Such a lattice arrangement is very simple and thus inexpensive in structure and design. The slide plates can be moved in conveying direction or transversely to the conveying direction.

The gas-inlet opening of each of the grate elements communicates, advantageously sealed off against the surroundings, with the openings in an associated area of the lattice section, as this is discussed in greater detail in connection with one exemplary embodiment. Each grate element forms in this manner, with the associated area of the lattice section, a cell so that no balancing flow from one cell to another can any longer occur in flow direction behind the lattice arrangement, whereas the balancing flows in front of the lattice are limited exactly by this resistance.

In grate elements, whereby the gas-inlet opening is designed as a rectangular opening with a front and a rear and two lateral boundary edges, the invention provides that the front and the rear boundary edge rest each sealingly on a bar of the grate bearer, and that the lateral boundary edges sealingly sit each on a fixed plate of the lattice section.

The slide plates are operated, for example, by operating rods connected to said plates or in the case of movable rows of grates through Bowden wires or the like connected to said rows.

BRIEF DESCRIPTION OF THE DRAWINGS

Several exemplary embodiments of the invention are illustrated in the drawings and will be described in greater detail hereinafter. In the drawings.

DETAILED DESCRIPTION

As was already remarked earlier, the possibility exists basically to provide a lattice arrangement with adjustable openings for one single large grate surface in order to be able to change the total resistance consisting of the resistance portions of the grate surface on the one hand and of the adjustable lattice arrangement on the other hand. In order to be able to differentiate the resistance of the grate surface according to individual grate-surface areas, there furthermore exists the possibility to divide the lattice arrangement into several lattice sections, which can be adjusted independently from one another, whereby the lattice sections, each sealed off against the surroundings, communicate with the associated area of the grate surface. It is thereby possible to divide the grate surface, for example, of a conveyor grate into areas lying one behind the other in conveying direction in order to be able to take into consideration the changed need for cooling air during an increasing cooling advance toward the grate end. Furthermore, it can be advantageous to divide the grate surface into areas lying side-by-side with respect to the conveying direction in order to be able to take into consideration, for example, grain-size variations on the right and left side of the conveyor grate due to the application through a revolving furnace.

The invention will be described hereinafter in connection with a stepped thrust grate, in which individual boxlike closed grate elements are each arranged on grate bearers forming a row of grates.

Figure 6:
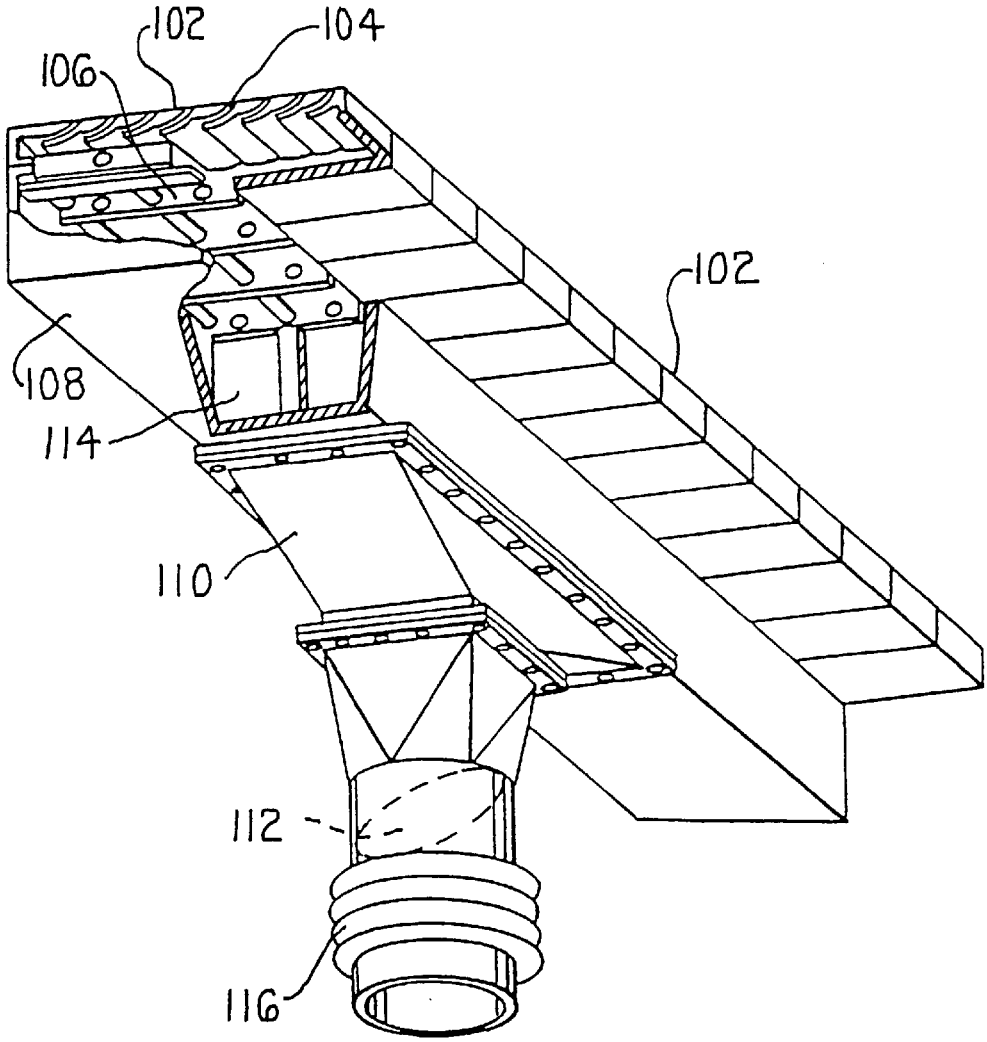
FIG. 6 (PRIOR ART)
FIG. 6 shows an air-beam arrangement according to the state of the art with portions of the housing cut-away to illustrate interior elements.

FIG. 6 illustrates a known construction wherein a row of grates of a loose-material grate is designed as a so-called air beam. Several boxlike grate elements 102 are thereby each arranged side-by-side forming a row of grates. The grate elements 102, which have air blow-off openings 104 at their upper side, sit air-tight with an air-inlet opening 106 at their underside on the grate bearer 108, which is constructed as an open top trough, however, is otherwise closed. The openings 104 can also be described as apertures having openings on respective ends as shown in FIG. 6. The grate bearer 108 is connected to an air-supply line 110, which is equipped with a throttle flap 112 for controlling the air supply. Further adjustable flaps 114 for a purposeful air distribution can be provided in the grate bearer 108. In case the illustrated row of grates is a movable row of grates, the air-supply line 112 is equipped with a flexible bellows 116, which enables a thrust movement of the movable row of grates.

The air-beam technique already permits a varying of the air blow-off from row to row and to thus adapt same, for example, in conveying direction to varying needed cooling performances. A differentiating between, with reference to the conveying direction, the left or right side of the grate, for example, through the flaps 114 was indeed possible up to a certain degree. However, these flaps 114 could not prevent a balancing flow in longitudinal direction of the grate bearer 108 so that during an air breakthrough at one point the air from the grate bearer 108 would flow to this point and would reinforce the air breakthrough. In order to guarantee a right/left differentiation without the possibility of an air-balancing flow, the grate bearer must be divided and each compartment must be connected to a separate air-supply line, which further increases the already large structural requirement and expense associated therewith.

It is obvious that for a separate control of individual air beams a number of supply lines corresponding with the number of air beams must be provided; in case a right/left differentiation is in addition desired, the number of air-supply lines can generally be doubled.

Figure 1:
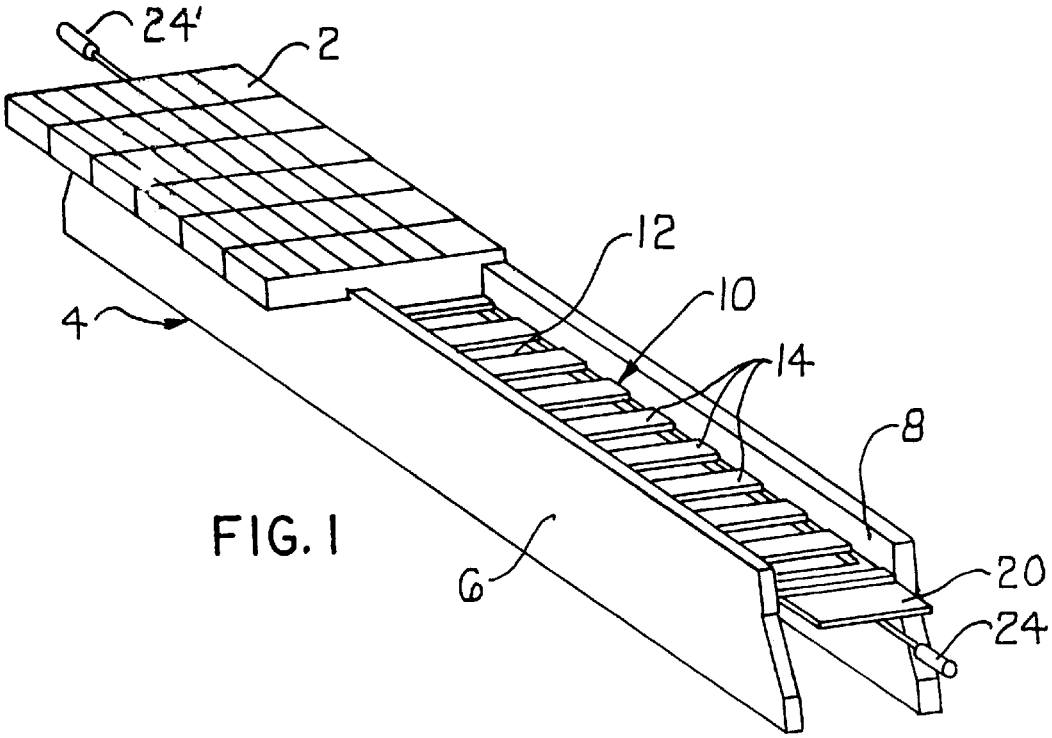
FIG. 1 is a perspective view of a grate bearer with grate elements arranged on said grate bearer, and an adjustable lattice arrangement arranged below the grate elements.
Figure 2:
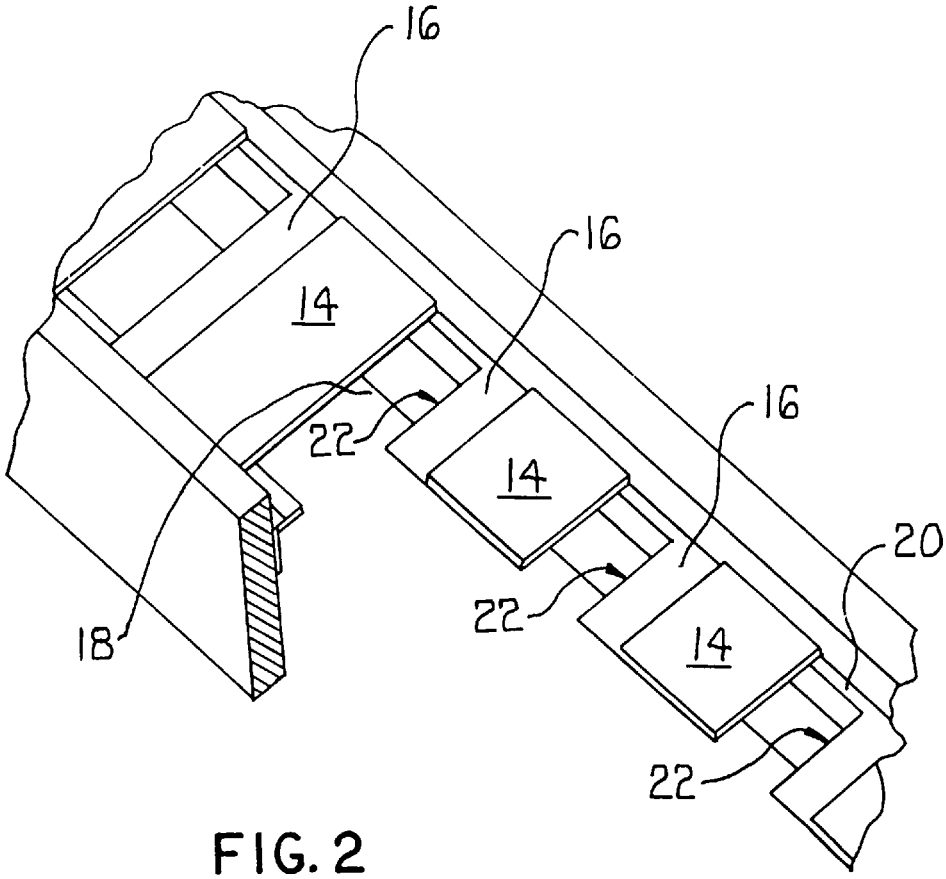
FIG. 2 is a perspective view of details of the adjustable lattice arrangement of FIG. 1 with portions of the flat bar, fixed plate, and movable plate cut-away for purposes of illustration.

FIG. 1 illustrates a design of the present invention, in which several boxlike grate elements 2 corresponding to the grate elements 102 described in connection with FIG. 6, are arranged side-by-side on a grate bearer 4 forming a row of grates. The grate bearer 4 is, in contrast to the grate bearer 108 illustrated in FIG. 6, not designed as an open top trough, but is however, otherwise closed. Specifically, it consists of two vertically oriented flat bars 6, 8 extending parallel to one another, onto which bars the grate elements 2 are placed, as this can be seen in FIG. 1. The air supply to one row of grates occurs through an air chamber arranged below the row of grates, as will be described in greater detail later on.

A lattice arrangement 10 with adjustable openings 12 is arranged below the grate elements 2, that is, within the grate bearer 4 between the bars 6, 8.

FIGS. 1 to 4 illustrate that the lattice arrangement 10 is constructed as a slide-plate lattice with fixed plates 14 and movable slide plates 16 movable relative to said fixed plates 14. Gaps 18 exist between the fixed plates 14, the size of which gaps each define the maximum size of the air openings. The slide plates 16 consist of an integrated slide member 20 which has openings 22 at spaced intervals corresponding with the width of the gaps 18. The slide member 20 can be adjusted through an operating rod 24 between a first end position in which the openings 22 are congruent with the gaps 18 (a fully open position), and a second position in which the surfaces, which remain between the openings 22 and form the actual slide plates 16, close off the gaps (fully closed position).

The slide-plate lattice can be formed very generally also out of two perforated sheet-metal plates or the like, which are arranged one above the other and have the same hole patterns, whereby the open position corresponds to the position in which the hole patterns are congruent, and the closed position corresponds to the position in which the holes of the perforated sheet-metal plates are moved relative to one another such that openings no longer exist, which does not need to be illustrated in any greater detail.

The operating rod 24 can, for example, also be replaced with a Bowden wire or the like, if we are dealing with a movable row of grates.

Figure 3:
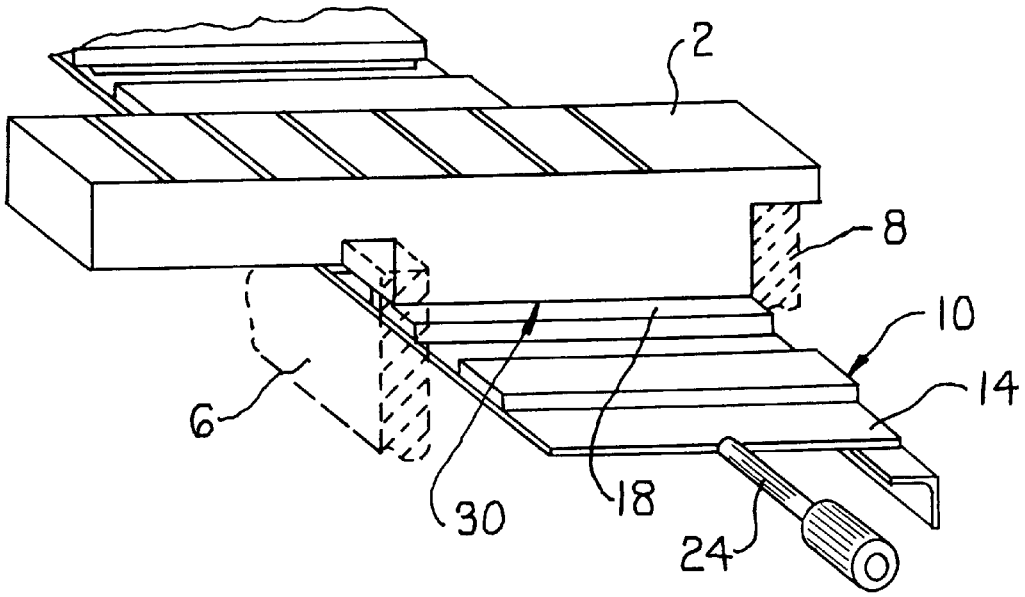
FIG. 3 is a perspective view of details of FIG. 1 in an enlarged illustration with portions of the flat bars cut-away.
Figure 4:
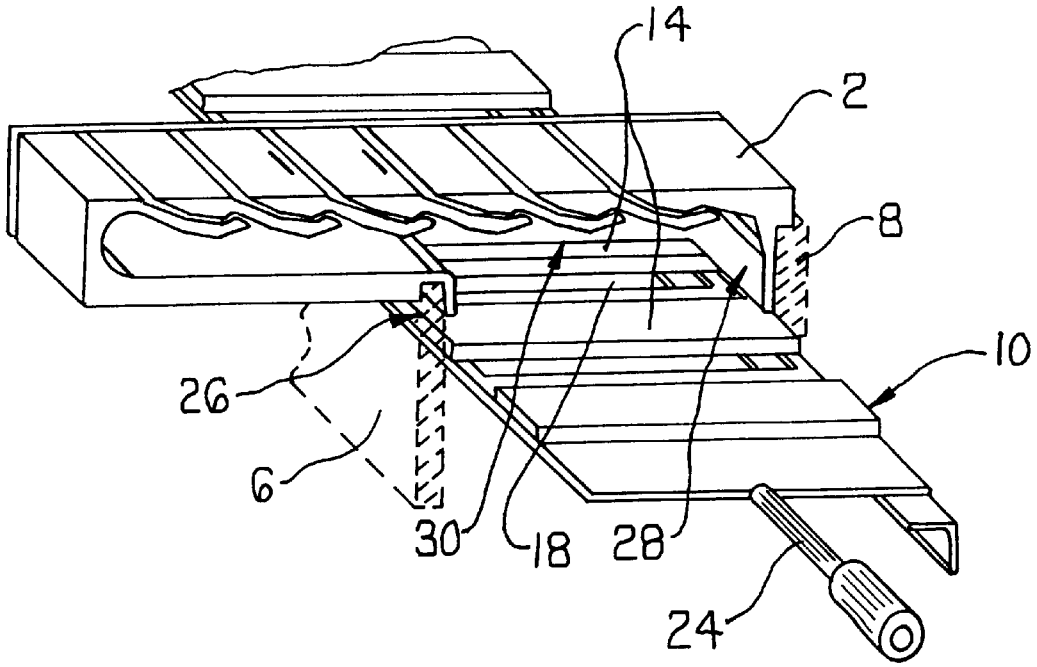
FIG. 4 is a view approximately corresponding to FIG. 3, whereby the grate element is cut open and the flat bars are cut-away.

FIGS. 3 and 4 illustrate examples for the arrangement of the grate elements 2 relative to the respective lattice arrangements 10. The grate elements 2 have essentially rectangular air-inlet openings with a front boundary edge 26, a rear boundary edge 28 and two lateral boundary edges 30, whereby FIG. 4 shows only the lateral boundary edge not facing the viewer, whereas the lateral boundary edge facing the viewer has been left out for reasons of illustration.

FIGS. 3 and 4 show that the front and the rear boundary edges 26, 28 rest sealingly on the bars 6 and 8 of the grate bearer 4. The lateral boundary edges 30 each rest on fixed plates 14. Each gap 18 formed between two fixed plates 14 and corresponding with the maximum air-supply opening communicates in this manner with the associated grate element 2 sealed off against the surroundings.

As shown in FIG. 4, adjustment to the size of the gaps 18 of the lattice arrangement 10 does not vary the effective open surface area of openings of the grate surface of the grate arrangement.

It is possible, with the described design, to separately control the resistance of individual rows of grates and to adapt in this manner the rate of air flow to the cooling demands changing in longitudinal direction of the grate. In order to also make possible a right/left differentiation, the lattice arrangement 10 is divided into at least two sections, which can be operated independently from one another; the sections can, as needed, have the same or different length. FIG. 1 shows schematically the possibility, when a division into two sections exists, to operate the section, which is the left one with reference to the conveying direction, through a first operating rod 24, the right section through an operating rod 24'.

The air supply to the individual rows of grates is done through air collectors or ventilating boxes arranged below the grate surface, which is generally known and is therefore not illustrated in any greater detail in FIGS. 1 to 4. The control of the rate of air flow through the individual rows of grates is exclusively accomplished by changing the entire grate resistance by means of adjusting the lattice arrangement 10.

FIGS. 1 to 4 show that each grate plate 2 communicates, sealed off against the surroundings, with a gap 18 formed between two fixed plates 14, which gap 18 is the air opening.

A small-cell division of the grate is in this manner created in the flow direction behind the lattice arrangement. Such an arrangement prevents, for example in the case of an air breakthrough, balancing air flowing from one cell to another with the damaging effect that, the air breakthrough becomes stronger and, a pressure drop occurs in other areas of the grate. Such a result is prevented because balancing air flows in front of the lattice arrangement are limited by its resistance.

Figure 5:
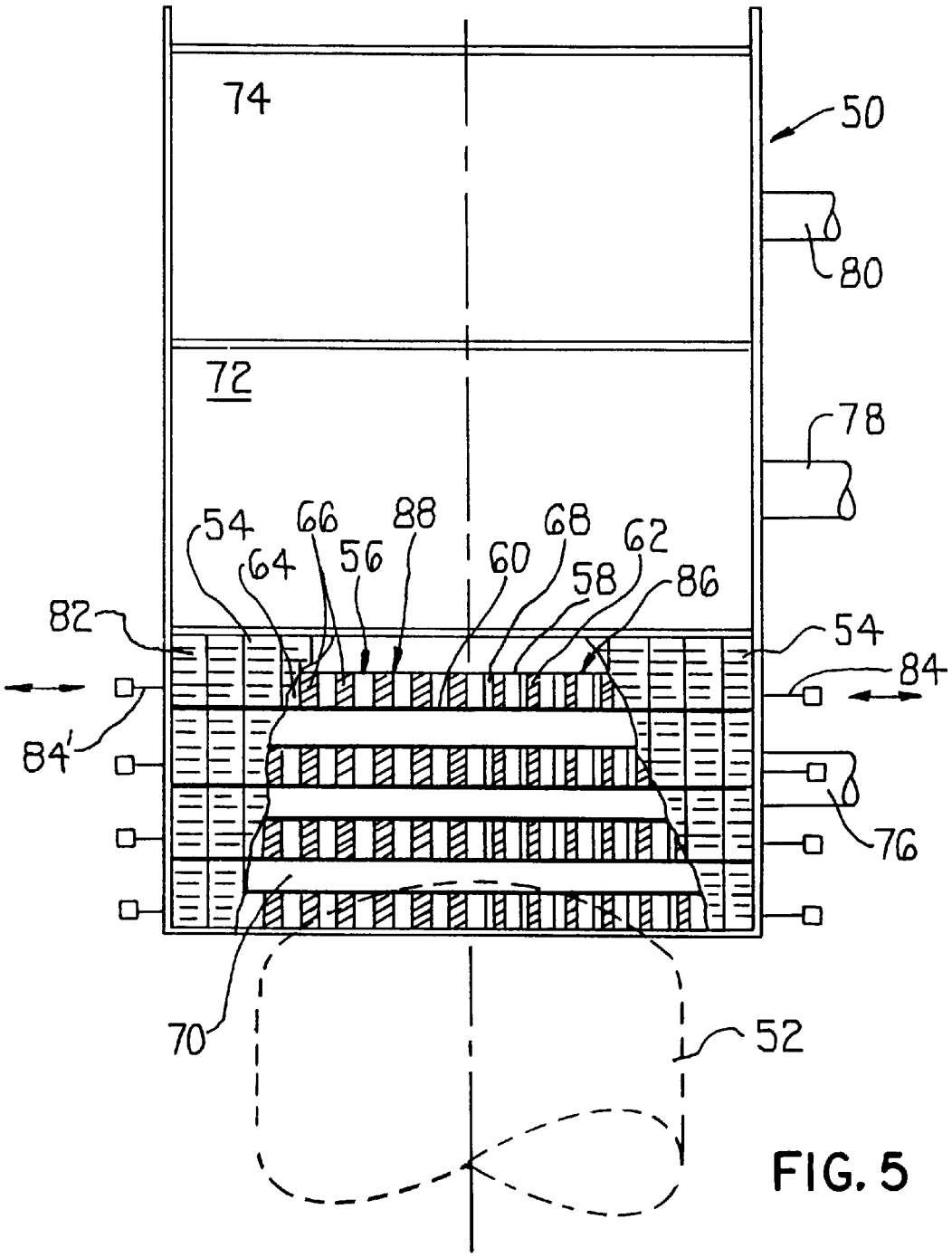
FIG. 5 is a top view of a loose-material grate according to the present invention with a portion of the grate elements cut-away.

FIG. 5 illustrates schematically a top view of a loose-material grate 50 according to the invention. The actual grate surface is formed by grate elements 54, which correspond essentially with the grate elements 2 described in connection with FIGS. 1 to 4. The grate elements 54 sit on the grate bearers 56, which correspond with the grate bearers 4 of FIGS. 1 to 4. Each lattice arrangement 62 is provided between two bars 58, 60 of a grate bearer 56, whereby at least one air-supply opening 64 is associated with each grate element 54. The air-supply opening 64 is formed been two fixed plates 66 and each can be closed off partially or entirely by one slide plate 68.

FIG. 5 shows that the gas-collecting arrangement arranged below the loose-material grate 50 is divided into several air chambers 70, 72, 74, which are each provided with separate air connections 76, 78, 80. A rough adaptation of the cooling-air performance to the need, which changes in conveying direction, can be achieved.

Four rows of grates 82 are associated in the illustrated exemplary embodiment with each of the air chambers 70, 72, 74. The air resistance of individual rows of grates 82 can be controlled individually through operating rods 84 in a manner described in connection with FIGS. 1 to 4 so that a control of the blow-out performance can be achieved within a grate area defined by one of the air chambers.

FIG. 5 shows that the lattice arrangements of one row of grates 82 are each divided into one right lattice section 86 and one left lattice section 88, whereby each lattice section can be operated through a separate operating rod 84 or 84'. A right/left differentiation of the grate resistance can also be achieved in this manner is in order to be able to adapt same, for example, to a grain-size distribution, which varies due to a feeding through a revolving furnace 52.

The embodiments of the invention in which an exclusive property or privilege is claimed are defined as follows:

1. In a loose-material grate, including a grate arrangement comprising grate apertures and having a grate surface for receiving loose material, an air chamber arranged below the grate arrangement for supplying the grate surface with a gas through the grate apertures of the grate arrangement to cool the loose material, the improvement comprising a lattice arrangement below said air chamber and having adjustable openings for controlling the flow of gas entering said air chamber and passing through the grate apertures to cool the loose material, the adjustable openings of said lattice arrangement being spaced from the grate surface so that an effective open surface area for the grate apertures is not varied in response to adjustment of the adjustable openings of said lattice arrangement, the adjustable openings communicating the gas to said grate apertures via said air chamber.

2. The loose-material grate according to claim 1, wherein said grate arrangement is divided into several grate sections, the adjustable openings of said lattice arrangement in each of said grate sections being adjustable independently from other adjustable openings in other said grate sections, the grate apertures of individual said grate sections being sealed off against the grate apertures of adjacent said grate sections.

3. The loose-material grate according to claim 2, wherein means are provided for conveying the loose material in a longitudinal direction along the loose-material grate, and wherein said lattice arrangement is divided into several lattice sections arranged one behind another in a longitudinal direction along the loose-material grate.

4. The loose-material grate according to claim 1, wherein means are provided for conveying the loose material in a longitudinal direction along the loose-material grate, and wherein said lattice arrangement is divided into several lattice sections arranged one next to another with respect to the longitudinal direction.

5. The loose-material grate according to claim 4, wherein said grate arrangement is divided into several grate sections, the adjustable openings of said lattice arrangement in each of said grate sections being adjustable independently from the other adjustable openings in other said grate sections, the grate apertures of said grate sections being sealed off against the grate apertures of adjacent said grate sections.

6. The loose-material grate according to claim 1, wherein the adjustable openings of said lattice arrangement can be adjusted between each of an open position in which the adjustable openings have a largest cross section, and a closed position in which the adjustable openings are closed.

7. The loose-material grate according to claim 1, wherein said grate arrangement comprises several box-shaped grate elements, said grate arrangement further comprising a grate bearer formed of two parallel bars, said lattice arrangement being supported by said grate bearer.

8. The loose-material grate according to claim 7, wherein each of said grate elements of said grate arrangement comprises a rectangular opening with a front and a rear and two lateral boundary edges, and wherein the front and the rear boundary edges each rest sealingly on a respective bar of said grate bearer, and wherein the lateral boundary edges each are sealingly disposed on a fixed plate of said lattice arrangement, thus forming said air chamber.

9. The loose-material grate according to claim 1, wherein said lattice arrangement comprises a slide-plate lattice including stationary plates and movable slide plates movable relative to said stationary plates to adjust the flow of gas to said air chamber and to the grate apertures.

10. The loose-material grate according to claim 9, wherein said slide plates are movable in a conveying direction.

11. The loose-material grate according to claim 9, wherein said slide plates are movable transversely to a conveying direction.

12. In a loose-material grate comprising:

a grate arrangement having a grate surface for receiving loose material and grate surface openings for enabling a gas to cool the loose material, said grate arrangement being divided into several grate sections sealed off against the grate surface openings of adjacent said grate sections;

respective chambers arranged below the grate surface of each respective said grate section for supplying the respective grate surface with a gas;

a plurality of air connections for individually supplying the gas to respective said chambers of respective said grate sections; and a lattice arrangement with adjustable openings for controlling the flow of the gas cooling the loose material, the adjustable openings corresponding to each of said grate sections and being adjustable independently from other ones of the adjustable openings of said lattice arrangement corresponding to other said grate sections, the adjustable openings of said lattice arrangement communicating with the grate surface openings of said respective grate section.

13. The loose-material grate according to claim 12, wherein said lattice arrangement comprises a slide-plate lattice including stationary plates and movable slide plates movable relative to said stationary plates to adjust the flow of gas to respective said air chambers of said grate sections.

14. The loose-material grate according to claim 13, wherein said slide plates are movable transversely to a conveying direction.

* * * * *